United States Patent [19]

Stewart et al.

[11] 3,952,665

[45] Apr. 27, 1976

[54] DEVICE FOR LATERALLY DISPLACING A RAILROAD TRACK

[75] Inventors: John Kenneth Stewart; Helmuth von Beckmann, both of Columbia, S.C.

[73] Assignee: Canron, Inc., Phillipsburg, N.J.

[22] Filed: Mar. 28, 1975

[21] Appl. No.: 562,923

[52] U.S. Cl. ..... 104/8; 33/1 Q; 254/43

[51] Int. Cl.[2] ..... E01B 33/02

[58] Field of Search ..... 104/8, 7 B; 254/43, 254/44; 33/1 Q, 144, 146, 338; 73/146

[56] References Cited

UNITED STATES PATENTS

| | | | |
|---|---|---|---|
| 2,736,268 | 2/1956 | Yohe | 104/8 |
| 3,240,161 | 3/1966 | Belau et al. | 104/8 |
| 3,314,373 | 4/1967 | Plasser et al. | 104/8 |
| 3,552,319 | 1/1971 | Plasser et al. | 104/8 |

FOREIGN PATENTS OR APPLICATIONS

| | | | |
|---|---|---|---|
| 1,152,130 | 8/1963 | Germany | 33/144 |
| 638,681 | 4/1962 | Italy | 33/144 |

*Primary Examiner*—Robert J. Spar
*Assistant Examiner*—Randolph A. Reese
*Attorney, Agent, or Firm*—Wenderoth, Lind & Ponack

[57] ABSTRACT

A method and a system for correcting the misalignment of a railroad track is provided which corrects the track by the steps of applying a force laterally of the track to move it in the direction of its correct position, sensing the track position relative to a datum, automatically reducing the force in response to the sensing step, permitting the track to react to the reduction of the force and automatically rapidly repeating the force application, sensing, and reduction steps to set up a vibratory cycle of force application until the desired track condition has been achieved. The system provides a valve which has a rail position feeler in the hydraulic connection between pump and jack, which feeler upon sensing the rail operates to close the valve to terminate a jacking action. Pressure sensitive switch is provided in the hydraulic connections between the valve and the pump that operates to exhaust the jack when a pre-determined pressure has been built up in the connections between the pump and the valve. This permits the track to react to the jacking action and move away from the feeler to re-open the valve and re-institute a jacking action. A counting circuit is provided to monitor the number of operations of the valve so as to control the number of jacking actions which are performed in an aligning operation.

8 Claims, 1 Drawing Figure

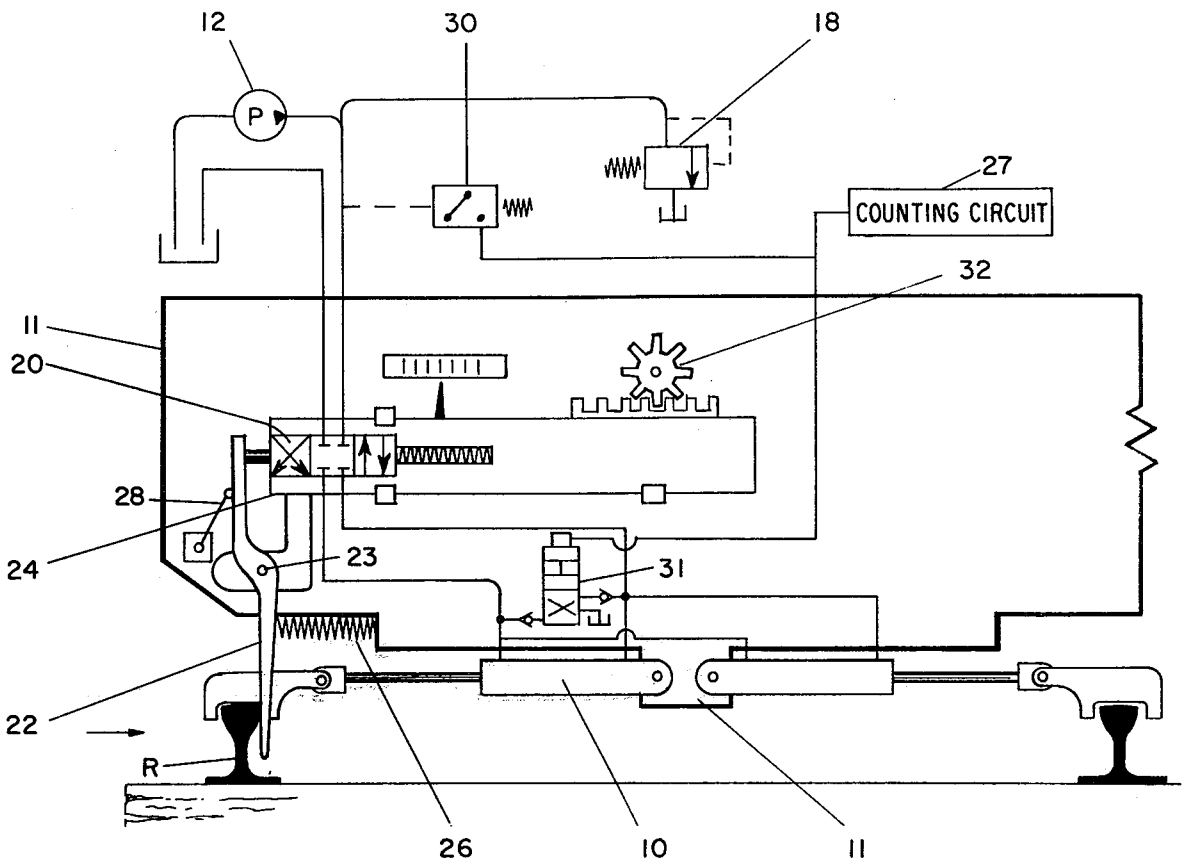
COUNTING CIRCUIT
27
32
18
30
12
P
11
20
28
24
23
31
22
R
26
10
11

DEVICE FOR LATERALLY DISPLACING A RAILROAD TRACK

BACKGROUND OF THE INVENTION

In railway track aligning operations the problem of spring-back of the rail producing a tendency to move the track, after correction, out of its corrected position has long been observed. Proposals have been made to overcome this phenomenon by overcorrecting the track during aligning, that is to say, moving the track from an incorrect position through and beyond its correct position to a degree which will compensate for the rail spring-back, such that after spring-back the rail, and consequently the track, will adopt a correct position.

While these methods have produced a satisfactory solution to the problem of rail spring-back in a number of applications certain ballast conditions have caused the application of these methods to be somewhat difficult and time consuming, and the results less than satisfactory.

SUMMARY OF THE INVENTION

The present invention overcomes the problem of spring-back of the rail by virtually shaking the track into its correct position and in so doing relieves the stresses which would tend to return the rail from its correct position by loosening the surrounding ballast and providing a new bed position for the corrected rail.

According to the present invention a method of correcting the misalignment of railroad track comprises the steps of: applying a force laterally of the track to move it laterally from an incorrect position in the direction of its correct position; sensing the track position relative to a datum; automatically reducing said force in response to the sensing step; permitting the track to react to the reduction of said force; and automatically rapidly, repeating said force application, sensing, and reduction steps to set up a vibratory cycling of force application until a desired track condition has been achieved.

Each application of lateral force, according to one embodiment of the invention, moves the track to substantially its correct position.

According to a further feature of the invention pulses of lateral force are initially provided to move the track from its incorrect position to its correct position and upon sensing that the track has reached its correct position the force application, sensing, and reduction steps are continued until the required track condition has been achieved.

The present invention also provides a control system for the cycling of a railroad track aligning jack, which system comprises a hydraulic pressure source; hydraulic connections between jack and source; a valve means in said connection; rail position feeler means operatively connected to said valve means and operable to close said valve means to terminate a track aligning jacking action; a pressure sensitive means operatively connected in the hydraulic connections between said valve means and said source and operable to exhaust said jack when a predetermined hydraulic pressure has been built up in the hydraulic connections between the source and valve means, to permit the track to react to a preceding track aligning jacking action and move from said feeler means to re-open the valve means and reinstitute a track aligning jacking action; and means for monitoring the number of operations of the valve means to control the number of jacking actions in an aligning operation.

In a preferred embodiment means is provided by positioning at least one of said valve means and said rail position feeler laterally of the track. Preferably, the positioning means is automatically controlled to move said valve means and/or feeler to a lateral location compensating for a track curve condition.

DESCRIPTION OF THE DRAWINGS

The following is a description by way of example of certain embodiments of the present invention reference being had to the accompanying drawings in which is a diagramatic illustration of a system for aligning track.

DESCRIPTION OF PREFERRED EMBODIMENTS

A track aligning jack 10 is mounted on the frame 11 of wheel mounted track correcting machine. Pressure to operate the jack is provided by a hydraulic pump 12 via hydraulic connections. It is to be understood that the hydraulic connections and indeed all the details shown in the drawing are diagramatic in nature. The system pressure is set by a pressure relief valve 18 at, say 2,000 lbs. P.S.I. Positioned in the hydraulic connections between the jack 10 and the pump 12 is a valve 20 which is shown in its closed position (i.e. when the track has reached its aligned position). The valve is spool operated by means of a rail position feeler 22 mounted at 23 on a reference frame 24 connected to the frame 11. The feeler 22 is biased as shown in FIG. 1, clockwise by means of a spring 26 against the alignment reference rail. A counting circuit 27 is operated by a micro-switch 28 which contacts the upper arm of the feeler 22 and counts the number of operations of the valve 20. Located in the hydraulic connections between the pump 12 and the valve 20 is a pressure sensitive switch 30. This switch is electrically connected to the solenoid valve 31 located in the exhaust line of the jack 10. The pressure switch 30 is set to operate at a pressure of 1,700 P.S.I. that is, at a pressure lower than the full system pressure.

Valve 20 and the feeler 22 may be moved laterally with frame 24 on the main frame 11 by means of a motor 32 which may be driven to move the reference frame 24 inward or outward of the frame 11 in accordance with control signals received from a control device of any known type, for example a chart recorder readout device, to position for reference frame 24 in curves so that it extends beyond the frame 11 by an amount sufficient for correct datum positioning of the valve 20 and feeler 22. Although the frame 24 is shown carrying both the valve 20 and the feeler 22 it will be understood that any suitable arrangement of moving either the feeler 22 or the valve 20 could be utilized provided a suitable shape of feeler 22 were used.

In operation the track correcting operation is initiated by the machine operator and pressure fluid from the pump 12 passes through the valve 20 to cause the jack 10 to move the rail R in the direction of the arrow. As the system pressure builds up, and if the feeler 22 has not sensed the rail R, by assuming the null-position at the valve the pressure switch 30 will, at say 1,700 P.S.I. operate the solenoid valve 31, to by-pass and exhaust the jack 10. This reduction of the aligning force by the jack 10 will permit the track to react and if there is inherent spring in the track there will be a tendency for the track to return in the direction of its incorrect position. However, as soon as solenoid valve 31 operates, pressure in the line from the pump will drop causing the pressure switch 30 to close the valve 31 and re-instate the application of pressure to the jack 10, which immediately causes a repeating of the jacking stroke. Since the time of operation of the pressure switch 30 and valve 31 is measured in mili-seconds it will be seen that the aligning force by the jack 10 is vibratory or pulsed in nature. This pulsing continues or, in the absence of track resistance building up a pressure in the system high enough to trip switch 30, on the first application of pressure to the jack 10, the track is moved to its correct position. The arrival of the track at its correct position will be sensed by the feeler 22 which is always located at a datum position. Movement of the feeler 22 against the bias of its spring 26, causes valve 20 to close off the pressure line from the pump 12 and the return line to the tank, the closed position of the valve being illustrated. Since the pump 12 is still operating pressure will build up in the pressure line and pressure switch 30 will operate to open valve 31 to exhaust the jack. Again the reduction of application of aligning force will cause the track to react and move away from the feeler 22, whereupon valve 20, is immediately re-opened and pressure restored so that jack 20 causes further application of an aligning force. Again, since the operation of the feeler 22 and the valve 20, is measured in mili-seconds the whole aligning operation operates as a vibratory cycle to shake the track into its correct position. When the track is in its correct position it is desirable to further shake it, to a greater or lesser degree depending upon the ballast condition and this shaking will continue until the desired track conditions have been achieved. The vibratory cycling at the correct position is controlled by adjusting the counting circuit 27 operated by micro-switch 28 to the required number of cycles suitable for the track condition.

In this way the track is always provided with the number of vibrations to leave it not only in the correct position but under the required conditions.

Occasionally an unusual track condition will be encountered where it may be necessary to move through the required position and beyond it, as is known in the art, to insure that the track bed beyond the desired position has received sufficient vibrations so that it too will achieve the required condition. To this end an override may be provided by deliberately displacing the frame 24 with the feeler 22 thereon to produce an overcorrected "null" position. This permits the track to be shaken through its desired resting position and beyond it before returning it to the required position.

What I claim as my invention is:

1. A method of correcting the misalignment of railroad track, comprising the steps of: applying a force laterally of the track to move it laterally from an incorrect position in the direction of its correct position; sensing the track position relative to a datum; automatically reducing said force in response to the sensing step; permitting the track to react to the reduction of said force; and automatically rapidly repeating said force application, sensing, and reduction steps to set up a vibratory cycling of force application until a desired track condition has been achieved.

2. A method as claimed in claim 1 in which each application of lateral force moves the track to substantially its correct position.

3. A method as claimed in claim 1 in which, initially, pulses of lateral force progressively move the track closer to its correct position and, upon sensing that the track has reached its correct position, the force application, sensing, and reduction steps are continued until said required track condition has been achieved.

4. A method as claimed in claim 1 in which the movement of the track laterally from its incorrect position in the direction of its correct position may exceed said correct position during vibration cycling, if necessary to achieve said desired track condition.

5. A control system for the cycling of a railroad track aligning jack comprising an hydraulic pressure source; hydraulic connections between jack and source; a valve means in said connections; rail position feeler means operatively connected to said valve means and operable to close said valve means to terminate a track aligning jacking action; a pressure sensitive means operatively connected in the hydraulic connections between said valve means and said source and operable to exhaust said jack when a predetermined hydraulic pressure has been built up in the hydraulic connections between the source and valve means, to permit the track to react to a preceeding track aligning jacking action and move from said feeler means to re-open the valve means and reinstitute a track aligning jacking action; and means for monitoring the number of operations of the valve means to control the number of jacking actions in an aligning operation.

6. A system as claimed in claim 5 in which means is provided for positioning at least one of said valve means and said rail position feeler laterally of the track.

7. A system as claimed in claim 6 in which the positioning means is automatically controlled to move at least one of the valve means and said rail position feeler to a lateral location compensating for a track curve condition.

8. A system as claimed in claim 5 in which said pressure sensitive means operates to exhaust said jack when a pressure lower than full system pressure has been built up.

* * * * *